United States Patent [19]

Mitchell

[11] Patent Number: 4,638,727

[45] Date of Patent: Jan. 27, 1987

[54] CHIMNEY COWLS

[76] Inventor: Arthur W. Mitchell, "Sandyacre", 18 Ballyardle Road, Kilkeel, County Down, Northern Ireland

[21] Appl. No.: 525,396

[22] Filed: Aug. 22, 1983

[51] Int. Cl.[4] ..... F23L 17/12

[52] U.S. Cl. ..... 98/79; 98/67; 98/78; 98/81

[58] Field of Search ..... 98/59, 67, 78, 79, 81, 98/83, 84, 122; 285/89, 404

[56] References Cited

U.S. PATENT DOCUMENTS

| | | | |
|---|---|---|---|
| 417,415 | 12/1889 | Esperson | 98/81 |
| 1,623,659 | 4/1927 | Comerford | 98/122 |
| 2,830,526 | 4/1958 | Breidert | 98/78 X |
| 4,335,648 | 6/1982 | Mitchell | 98/83 X |

FOREIGN PATENT DOCUMENTS

| | | | |
|---|---|---|---|
| 2913968 | 10/1980 | Fed. Rep. of Germany | 285/404 |
| 711640 | 9/1931 | France | 98/78 |
| 216358 | 8/1941 | Switzerland | 98/79 |
| 907869 | 10/1962 | United Kingdom | 98/84 |

OTHER PUBLICATIONS

"Aerocowl", Aerocowl Marketing LTD., Belfast 731611/3.

*Primary Examiner*—Harold Joyce
*Attorney, Agent, or Firm*—Lane & Aitken

[57] ABSTRACT

A device for clamping in position to a chimney outlet, a chimney cowl having a vertically-spaced series of three annular vanes centered on a common vertical axis, the device comprising a clamping ring formed by an annular surround spaced below the lowermost vane and being fixed to the lowermost vane. The surround has provided therein tapped bores engaged by screw-threaded elements for urging inwardly against the sides of a chimney outlet.

4 Claims, 4 Drawing Figures

CHIMNEY COWLS

This invention relates to chimney cowls.

Heretofore, many attempts have been made to alleviate, in particular, downdrafts which occur in chimneys or flues (hereinafter in the specification and claims referred to as "chimneys") associated with both domestic and industrial fuel burning appliances. There have been produced a large number of devices, the devices for mounting onto or into the tops of such chimneys, ranging from a simple hollow conical device mounted over the chimney opening or mushroom shaped cowls to sophisticated aerodynamically designed vertical deflectors which have been used on industrial chimneys.

All these devices have many disadvantages, the most prominent one being that, in use, each contributes to back pressure within the chimney system and amounts to relatively little more than wind deflectors which tend to change the wind direction at the chimney outlet but in no way make use of the wind energy in order to alleviate troublesome downdrafts.

To overcome these disadvantages I have invented chimney cowls described and shown in U.S. Pat. Nos. 4,206,693 and 4,335,648, and this invention relates to improved means for clamping same to a chimney outlet.

The present invention is means for clamping in position to a chimney outlet a chimney cowl comprising a series of annular vanes lying in spaced horizontal planes, the uppermost and lowermost of which are parallel and substantially frusto-conical in shape, said vanes having central apertures and centered about a common axis and arranged in a predetermined vertical spaced relationship, a plurality of supports connected to said vanes and positioned parallel to and radial of said axis, the lower two of said vanes converging towards their centers to form a venturi at their inner peripheries, and a device of aerodynamic shape mounted co-axially with the vanes and located between the upper two vanes, the device being circular in plan and masking the central apertures in the vanes and having upper and lower convex air-deflecting walls arranged base-to-base about said common axis, the upper wall of the device being parallel or substantially parallel to the uppermost and lowermost vanes, the means comprising a clamping ring formed by an annular surround spaced below and fixedly attached to said lowermost vane, and having provided therein two or more tapped bores each engaged by a screw-threaded element for urging inwardly against the sides of a chimney outlet.

Preferably, each element has a winged nut in threaded engagement thereon to serve as a fail-safe clamping device.

An embodiment of the present invention will now be described, by way of example, with reference to the accompanying drawings, in which.

Figure 1:
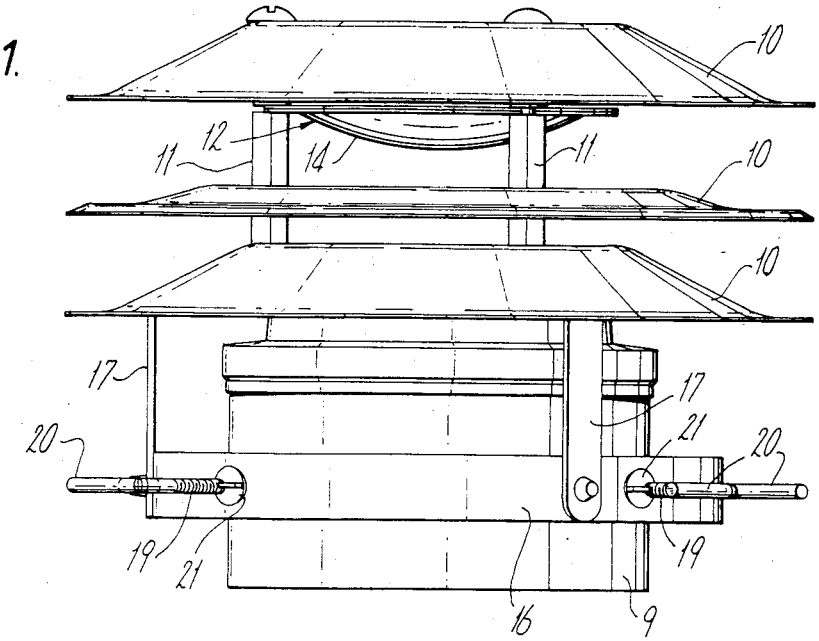
FIG. 1 is a side view of a chimney cowl according to the present invention.
Figure 2:
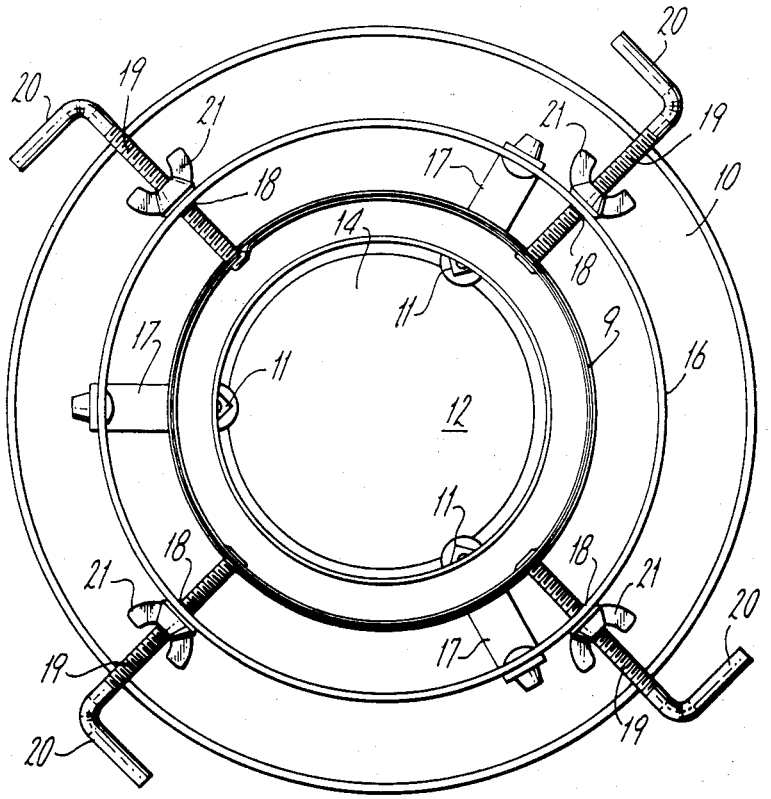
FIG. 2 is a underneath plan view.
Figure 3:
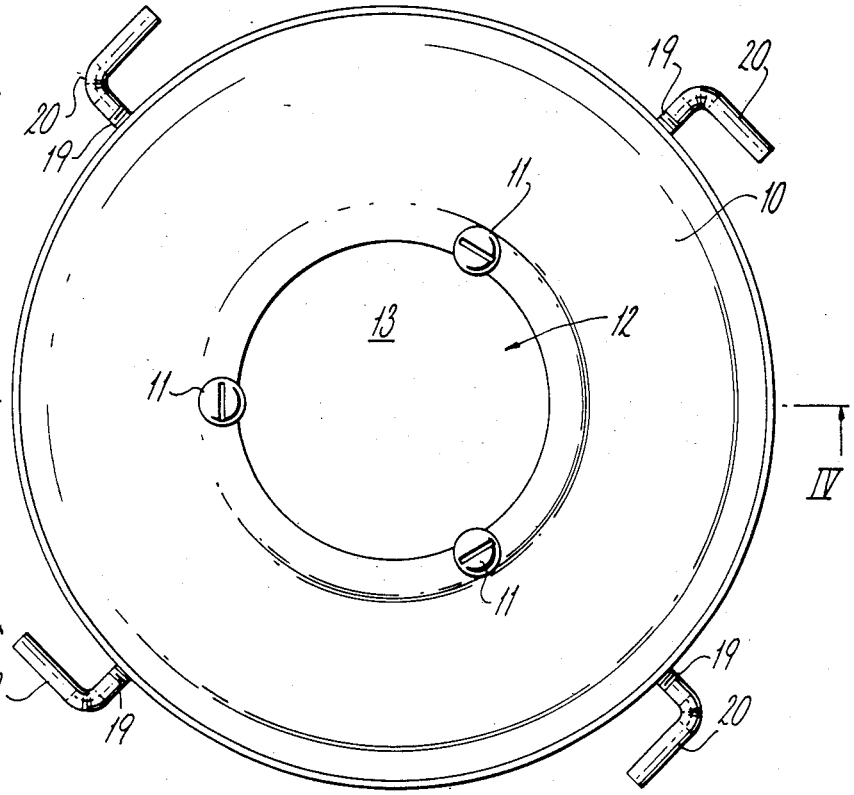
FIG. 3 is a plan view.

Referring to the drawings, a chimney cowl for fitment to a chimney to mask the outlet thereon is hereinafter described when fitted to the chimney. The cowl comprises a vertically spaced series of three annular vanes 10 centered on a common vertical axis. The vanes 10 are carried by three supports 11 which are positioned at the inner peripheries of the vanes 10 and are at equally spaced intervals therearound. The longitudinal axes of the supports 11 are parallel to the common vertical axis of the vanes 10. The uppermost and lowermost vanes 10 are parallel and are of quasi-frusto-conical shape, the angle to the horizontal being, for example, between 10° and 15°, and the intermediate vane 10 is horizontal and normal to the vertical axis of the vanes 10. The supports 11 mount co-axially with said vanes and between the uppermost vane 10 and the intermediate vane, a device 12 providing two aerofoils 13 and 14. The aerofoil 13 is constituted by a convexly dished or upper wall, parallel with the uppermost and lowermost vanes 10, and the aerofoil 14 is constituted by an inner or lower wall of inverted convex dished shape which seats within and is secured to the wall 13. The device 12 masks from above the central apertures in the intermediate vane and lowermost vane 10. The aerofoils 13 and 14 each have a skirt 15 which peripherally extends into the space between the uppermost vane and the intermdiate vane.

Means for clamping the cowl in the chimney outlet 9 comprises a clamping ring formed by an annular surround 16 spaced below said lowermost vane and being fixedly attached thereto by three angle brackets 17, the outer end of one arm of each bracket being welded to the surround 16 and the outer end of the other arm being secured to the bottom of a pertaining support 11. The surround 16 is dimensioned to fit over the chimney outlet 9. The axis of the surround is aligned with the common vertical axis of the vanes 10, and the surround 16 is provided with four tapped bores 18 radially of said axis and arranged in two diametrically-opposed pairs, one pair being at right-angles to the other pair. Each bore hs a screw-threaded element 19 engaged therein, the element having an outer finger grip 20 for manually urging the element inwardly to abut against and thereby clamp the cowl to the chimney outlet 9 or to release same to allow the cowl to be removed for chimney cleaning or sweeping. Each element 19 has a winged nut 21 in threaded engagement thereon to serve as a fail-safe clamping device, the nut 21 being urged against the surround 16 after the element 19 abuts the chimney outlet, releasing of the nut being necessary before element 19 can be released.

The above-described chimney cowl has been designated on the principle that the energy of the wind can be used to alleviate the problem of downdrafts and is based on the well known venturi principle which in this case is used so that negative pressures are generated at the outlet 9 of the chimney under windy condition, irrespective or whether or not the wind direction is changing or whether the wind is discontinuous and is occuring in gusts.

The venturi created between the bottom vane 10 and the intermediate vane 10 at their inner peripheries to due to the convergence of said vanes 10 as hereinbefore described whereby acceleration of airflow is created. Above the venturi is an expansion chamber which occupies the space defined centrally of the vanes, and is topped by the lower aerofoil of the device 12.

This aerofoil 14 reduces the negative pressure within the cowl even further and smooths the airflow through the cowl. The upper aerofoil 13 denies access to the chimney of rain, snow, hail and birds.

An annular gap is provided between the lowermost vane 10 and the chimney outlet as shown through which gap the venturi can draw air if required.

Figure 4:
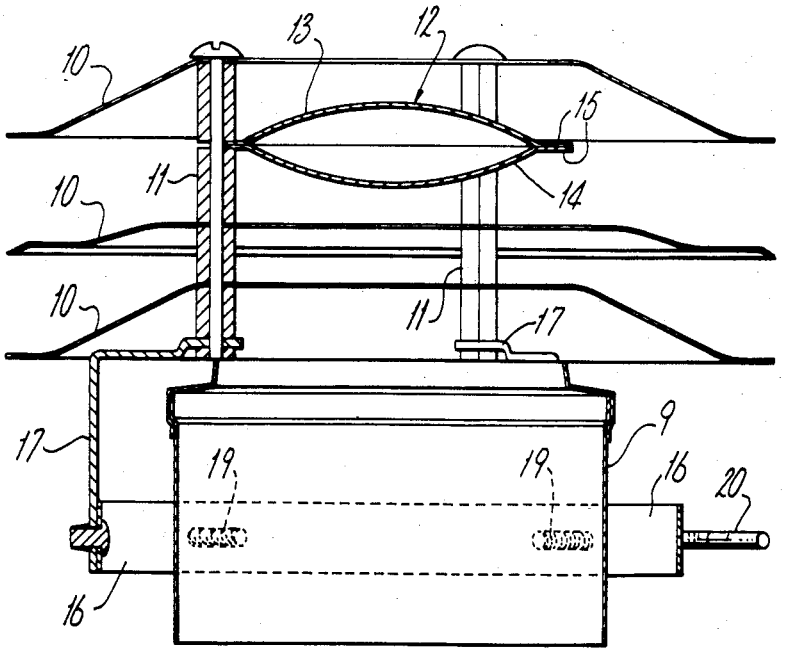
FIG. 4 is a cross-sectional view on the line IV—IV of FIG. 3.

Once clamped in position in the chimmey outlet the angles of the vanes 10 and aerofoil 13 and 14 prevent downdrafts entering the chimney directly from any angle. The downdrafts are deflected by the vanes 10 across the chimney outlet and in this way are converted into laminar airflow through the cowl, flowing from one side to the other. If we look at FIG. 4 airflow from left to right, at outlet level, is deflected upwards by the bottom vane 10 and compressed and accelerated in the venturi formed by the vanes 10 as hereinbefore described. This caused a reduction in the pressure of the air above the chimney outlet causing better extraction of gases from the chimney.

Airflow above between the other vanes 10 enters the expansion chamber causing, again a fall in air pressure and this is increased by the airflow passing over the inverted aerofoil.

This reduces chimney outlet pressures even further, again enhancing gas extraction. The size and position of the vanes 10 prevents rain and birds access to the chimney outlet.

The outer diameter of the vanes 10 and the diameter of the apertures in the vanes 10 are governed by the size of the chimney outlet 9, and therefore a variety of sizes of cowls can be provided to suit with the different sizes of chimney outlets in use.

The clamping means used to clamp the cowl in position as shown in the drawings of U.S. Pat. Nos. 4,206,693 and 4,335,548 have proved difficult to remove to allow for chimney sweeping and the present invention is intended to overcome this difficulty.

Any number of intermediate vanes 10 can be used without departing from the scope of the invention.

The cowls of the above-described invention are used with chimney pots.

The material of construction can be mild steel which can be made corrosion proof by the use of surface coatings such as epoxy resins, PTFE, or pure sprayed aluminium. Other materials of construction will be apparent to those skilled in the art; examples of such materials are stainless steel and high purity aluminium.

I claim:

1. Means for clamping to a chimney outlet, said outlet having an outside surface, an inside surface and a top surface, a chimney cowl comprising a series of annular vanes lying in spaced horizontal planes, the uppermost and lowermost of which are parallel and substantially frusto-conical in shape, said vanes having central apertures and centered about a common axis and arranged in a predepernimed vertical spaced relationship, a plurality of supports connected to said vanes and positioned parallel to and radial of said axis, respective brackets connected to said supports, the lower two of said vanes converging toward their centers to form a venturi at their inner peripheries, and a device of aerodynamic shape mounted co-axially with the vanes and located between the upper two vanes, the device being circular in plan and masking the central apertures in the vanes and having upper and lower convex air-deflecting walls arranged base-to-base about said common axis, the upper walls of the device being parallel or substantially parallel to the uppermost and lowermost vanes, the means comprising a clamping ring formed by an annular surround spaced below and connected via said brackets to said supports beneath said lowermost vane, and having provided therein two or more tapped bores each engaged by a screw-threaded element for urging inwardly against the outside surface of a chimney outlet whereby said cowl is mounted on said outlet without contact with or extending within the confines of the inside surface of the chimney outlet, said supports contacting said top surface and said screw-threaded elements contacting said outside surface.

2. Means according to claim 1, wherein each element has a winged nut in threaded engagement thereon to serve as a fail-safe clamping device.

3. A chimney cowl for attachment to a chimney outlet, said outlet having an outside surface, an inside surface, and a top surface, comprising:

a cowl structure defined by a plurality of centrally apertured annular canes arranged in spaced horizontal planes co-axially along a vertically aligned axis, a plurality of supports connected to said vanes for supporting said vanes relative to said axis in said spaced relationship, respective brackets connected to said supports;

a circular device mounted co-axially with said vanes between two adjacent vanes remote from the chimney outlet end of said cowl structure and masking the central apertures in said vanes; and means for clamping said cowl structure to the outside surface of a chimney outlet, said means comprising a clamping ring formed by an annular surround spaced below and connected via said brackets to said supports beneath said lowermost vane, and having provided therein two or more tapped bores each engaged by a screw-threaded element for urging inwardly against the outer sides of a chimney outlet whereby said cowl is mounted on said outlet without contact with or extending within the confines of the inside surface of the chimney outlet, said supports contacting said top surface and said screw-threaded elements contacting said outside surface.

4. The chimney cowl according to claim 3, wherein each element has a winged nut in threaded engagement thereon to serve as a fail-safe clamping device.

* * * * *